United States Patent [19]

Willem

[11] 4,409,433

[45] Oct. 11, 1983

[54] BINDING FOR RETAINING AN ELECTRICAL CONDUCTOR IN A TOP GROOVE ON A RIGID INSULATOR WHICH ALSO HAS A CIRCUMFERENTIAL GROOVE

[75] Inventor: Michel Willem, Abrest, France

[73] Assignee: Societe Anonyme dite: Ceraver, Paris, France

[21] Appl. No.: 400,370

[22] Filed: Jul. 21, 1982

[30] Foreign Application Priority Data

Apr. 6, 1982 [FR] France ..... 82 05930

[51] Int. Cl.[3] ..... H01B 17/22

[52] U.S. Cl. ..... 174/172; 24/261 R

[58] Field of Search ..... 174/163 R, 168, 172, 174/173; 24/115 N, 131 C, 261 R, 261 C, 279, 283, 339; 248/74 R; 256/54, 55, 56, 57, DIG. 3

[56] References Cited

U.S. PATENT DOCUMENTS

| | | | |
|---|---|---|---|
| 996,211 | 6/1911 | Carswell | 256/55 |
| 2,421,286 | 5/1947 | Pyle | 174/173 |
| 2,643,283 | 6/1953 | Carlson | 174/173 X |
| 2,897,256 | 7/1959 | Kitselman et al. | 174/173 |
| 2,911,695 | 11/1959 | Knight et al. | 174/173 |
| 3,918,685 | 11/1975 | Lindsey et al. | 174/172 X |

FOREIGN PATENT DOCUMENTS

| | | | |
|---|---|---|---|
| Ad.41450 | 10/1932 | France | 174/172 |
| 1313890 | 11/1962 | France | 174/173 |
| 2393450 | 12/1978 | France | 174/173 |
| 2493585 | 5/1982 | France | 174/173 |

*Primary Examiner*—Laramie E. Askin

*Attorney, Agent, or Firm*—Kenyon & Kenyon

[57] ABSTRACT

The binding is disposed substantially symmetrically about a plane of symmetry which passes through the insulator and which is orthogonal to said conductor (10). It comprises a first ring (8) for occupying a portion of the circumferential groove, a second ring (9) for occupying the top groove, two conductor-retaining branches (5), and tightening means (2, 11) for tightening the binding. Each of said branches comprises a first end portion (7) in the form of a preformed spiral retainer for wrapping around said conductor, an intermediate portion for threading through said second ring when lodged in the top groove and through said first ring when lodged in the circumferential groove, and then extending in an arc of the same diameter as the circumferential groove to a second end portion which provides an eye (6) for engaging the tightening means.

9 Claims, 3 Drawing Figures

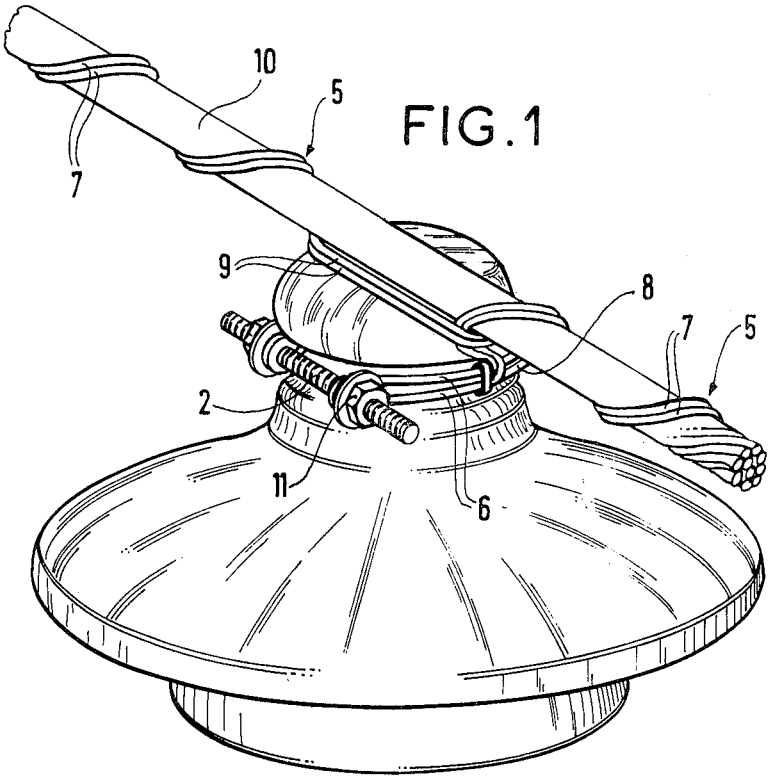
FIG. 1
FIG. 2
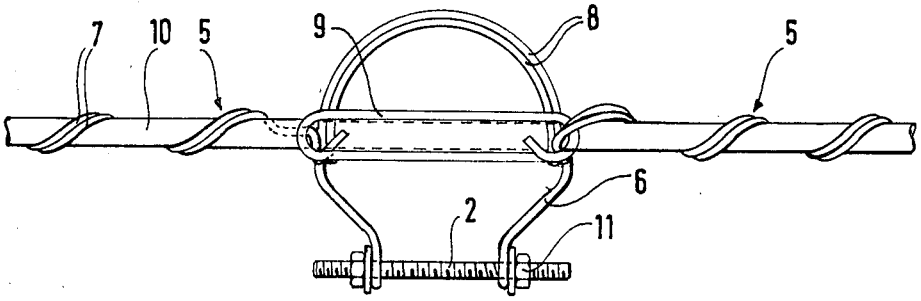
FIG. 3
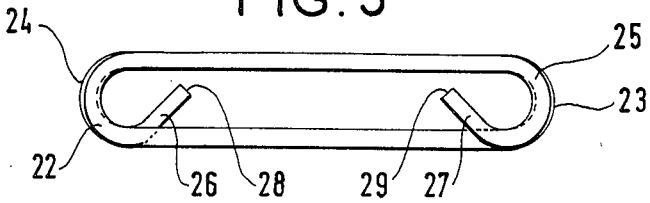

BINDING FOR RETAINING AN ELECTRICAL CONDUCTOR IN A TOP GROOVE ON A RIGID INSULATOR WHICH ALSO HAS A CIRCUMFERENTIAL GROOVE

The present invention relates to fixing an electrical conductor in a top groove of a rigid insulator.

BACKGROUND OF THE INVENTION

The French patent application No. 81 15205, filed 5th Aug. 1981, describes a binding for retaining a conductor in a circumferential groove of a rigid insulator.

This binding is disposed substantially symmetrically about a plane of symmetry which passes through the insulator and which is orthogonal to the conductor. It comprises a ring, two conductor-retaining branches, and tightening means for tightening the binding. Each of said branches comprises a first end portion in the form of a preformed spiral retainer for wrapping around said conductor, an intermediate portion for threading through said ring and then proceeding in an arc around a portion of the circumferential groove, and a second end portion in the form of an eye for engaging the tightening means.

Typically the branches are each made from a length of wire bent double in the middle both to form said eye and to enable two strands of wire to be joined together over most of the rest of the length of the branch to constitute a ribbon that is wider than it is thick.

The present invention seeks to adapt such a binding to the case where the insulator also has a groove running along its top, and where the conductor is retained in the top groove rather than in the circumferential groove.

SUMMARY OF THE INVENTION

The present invention provides a binding for retaining an electrical conductor in a top groove on a rigid insulator which also has a circumferential groove, the binding being disposed substantially symmetrically about a plane of symmetry which passes through the insulator and which is orthogonal to said conductor, and comprising a first ring for occupying a portion of the circumferential groove, a second ring for occupying the top groove, two conductor-retaining branches, and tightening means for tightening the binding, each of said branches comprising a first end portion in the form of a preformed spiral retainer for wrapping around said conductor, an intermediate portion for threading through said second ring when lodged in the top groove and through said first ring when lodged in the circumferential groove, and then extending in an arc of the same diameter as the circumferential groove to a second end portion which provides an eye for engaging the tightening means.

Preferably, each branch is constituted by at least one length of metal wire bent double in the middle to constitute said eye.

The rings may also be made from bent wire, with each end of the rings having at least one hair-pin bend superposed on at least one open spiral turn.

It is then advisable for the tips of the ring-forming wires to be curved slightly to avoid any outward projections.

The first ring may occupy substantially one half of the circumference of the circumferential groove.

BRIEF DESCRIPTION OF THE DRAWING

An embodiment of the invention is shown by way of example with reference to the accompanying drawing, in which:

FIG. 1 is a diagrammatic perspective view of an insulator supporting a conductor in a top groove and fitted with a binding in accordance with the invention;

FIG. 2 is a diagrammatic plan view of the binding of FIG. 1, with the conductor shown partially cut away and with the insulator not shown, in order to clarify details of the binding in the middle of the figure; and FIG. 3 is a side view on a larger scale of a ring used in the binding.

MORE DETAILED DESCRIPTION

The binding is made of resilient metal wire, preferably stainless steel or Alumoweld, and comprises two branches 5 each having an eye 6 at one end and a spiral portion 7 at the other. A first ring 8 is curved into a semi-circle and is lodged in the circumferential groove of the insulator, with its ends being substantially diametrically opposed. A second ring 9 is generally elongate and is lodged in the top groove. Each of the branches 5 passes through one end loop of each of the rings.

The rings are made of bent wire, and each end comprises at least one hair-pin bend superposed on at least one open spiral turn.

FIG. 3 shows such a ring in greater detail.

At each end of the ring there is a hair-pin bend 22, 23 superposed on an open spiral turn 24, 25. The bearing surface between the ring and the branch threaded through it thus occupies at least two strands of ring wire, thereby helping to reduce damage to the binding.

Further, the end portions 26 and 27 of the wire constituting the rings are curved to lie in the "inside" plane of the ring so that the tips 28, 29 do not project outwardly where they might otherwise damage the conductor or the insulator. The rings are preferably made of stainless steel, Alumoweld (aluminum+steel), or Almelec.

Likewise, each branch of the binding should be made of a length of wire of the same metal bent double in the middle to constitute respective eyes 6. Away from the eyes, the strands are made fast to each other to form a flat ribbon of wire that is wrapped around the conductor 10.

As shown in FIGS. 1 and 2, the tightening means for drawing the eyes 6 towards each other in the circumferential groove comprise a rod 2 having threaded ends fitted with nuts 11. The middle portion of the rod 2 may be threaded through a block of elastomer that bears against the bottom of the circumferential groove of the insulator.

As described in the above-mentioned French patent apllication No. 81 15205, said block of elastomer may be in the form of a cylinder of suitable cross section.

Alternatively, a stack of washers of differing diameters could be used, thereby providing a better fit between the rod 2 and the groove, while using less elastomer, which would also be cheaper.

To make use of the binding, it is loosened and placed on an insulator. The conductor 10 is placed on the ring 9, and the spiral portions 7 are wrapped around the conductor. The nuts 11 are then tightened, thereby jamming the arcuate portions of the branches 5 between the rod 2 and the ring 8 in the circumferential groove, while simultaneously causing the ring 9 to bear against the top groove and the conductor 10 to bear against the ring 9.

The invention provides the following advantages:

The binding prevents the conductor and the binding from oscillating relative to the insulator, thereby avoiding wear.

A single type of tightening means can be used both for bindings to hold the conductor in a top groove and for bindings to hold the conductor in the circumferential groove.

The binding provides improved residual retention between the cable and the insulator in the event that the insulator head is fractured.

Radio interference is reduced by eliminating play between the binding and the insulator.

It is possible to remove the conductor and the binding from an insulator without separating the conductor and the binding from each other. It is thus possible to replace an insulator while keeping the conductor under tension.

I claim:

1. A binding for retaining an electrical conductor in a top groove on a rigid insulator which also has a circumferential groove, the binding being disposed substantially symmetrically about a plane of symmetry which passes through the insulator and which is orthogonal to said conductor, and comprising a first ring for occupying a portion of the circumferential groove, a second ring for occupying the top groove, two conductor-retaining branches, and tightening means for tightening the binding, each of said branches comprising a first end portion in the form of a preformed spiral retainer for wrapping around said conductor, an intermediate portion for threading through said second ring when lodged in the top groove and through said first ring when lodged in the circumferential groove, and then extending in an arc of the same diameter as the circumferential groove to a second end portion which provides an eye for engaging the tightening means.

2. A binding according to claim 1, wherein the first ring occupies substantially one half of the circumference of the circumferential groove.

3. A binding according to claim 1, wherein the first and second rings are made from a folded length of metal wire, and wherein each end of the rings includes at least one hair-pin portion of wire superposed on an open spiral turn.

4. A binding according to claim 3, wherein the tips of the lengths of bent wire constituting the rings are slightly curved to avoid projecting outwardly.

5. A binding according to claim 1, wherein each branch is constituted by at least one metal wire bent double in the middle to constitute said eye.

6. A binding according to claim 1, wherein said tightening means for drawing together the eyes in the circumferential groove comprise an assembly of a threaded rod and at least one nut.

7. A binding according to claim 6, wherein the threaded rod passes through at least one elastomer block which bears against the bottom of the circumferential groove.

8. A binding according to claim 7, wherein the elastomer block is cylindrical in shape.

9. A binding according to claim 7, wherein the elastomer block is constituted by a stack of washers of different diameters.

* * * * *